United States Patent [19]

Manten

[11] 4,340,122

[45] Jul. 20, 1982

[54] MOUNTED DRILLING APPARATUS

[75] Inventor: Heinrich Manten, Salzgitter, Fed. Rep. of Germany

[73] Assignee: Salzgitter Maschinen und Anlagen Aktiengesellschaft, Salzgitter, Fed. Rep. of Germany

[21] Appl. No.: 172,846

[22] Filed: Jul. 24, 1980

[30] Foreign Application Priority Data

Aug. 1, 1979 [DE] Fed. Rep. of Germany ..... 2931208

[51] Int. Cl.[3] ..... E21C 1/10; E21C 11/00; E21C 27/20; E21C 31/02

[52] U.S. Cl. ..... 175/78; 173/23; 173/32; 173/147; 173/160; 175/62; 175/122; 175/203

[58] Field of Search ..... 175/122, 203, 78, 62; 299/56, 58, 57; 173/32, 33, 147, 152, 160, 23

[56] References Cited

U.S. PATENT DOCUMENTS

| | | | |
|---|---|---|---|
| 2,102,706 | 12/1937 | Hirschberg | 173/152 X |
| 2,719,708 | 10/1955 | Compton | 173/147 X |
| 2,732,181 | 1/1956 | Farmer, Jr. | 173/147 X |
| 2,887,299 | 5/1959 | Hurd | 173/147 X |
| 3,118,509 | 1/1964 | Adams et al. | 173/160 |
| 3,288,229 | 11/1966 | Chappius | 173/147 X |
| 3,613,804 | 10/1971 | Jonsson | 173/32 X |
| 3,834,761 | 9/1974 | Ray et al. | 173/23 X |
| 3,949,815 | 4/1976 | Bryant, Jr. et al. | 173/23 |

*Primary Examiner*—Stephen J. Novosad
*Attorney, Agent, or Firm*—Michael J. Striker

[57] ABSTRACT

The drilling apparatus includes a mount in the form of a cylindrical member defining an elongated passageway and being provided with two opposite guiding rails each being formed with an elongated recessed channel communicating with the passageway; a rotary drive for holding a drill rod has a non-rotating casing provided with guiding elements movable in the recesses of the guiding rails; a feeding mechanism for advancing the rotary drive includes either tooth racks arranged in the recesses of the guiding rails and driving pinions mounted on the casing of the rotary drive or cylinder and piston units located in the recesses of the guide rails and cooperating with feed cables or chains. The mount is supported on a mobile undercarriage which is provided with two pairs of vertically adjustable supporting legs.

17 Claims, 13 Drawing Figures

Fig. 11
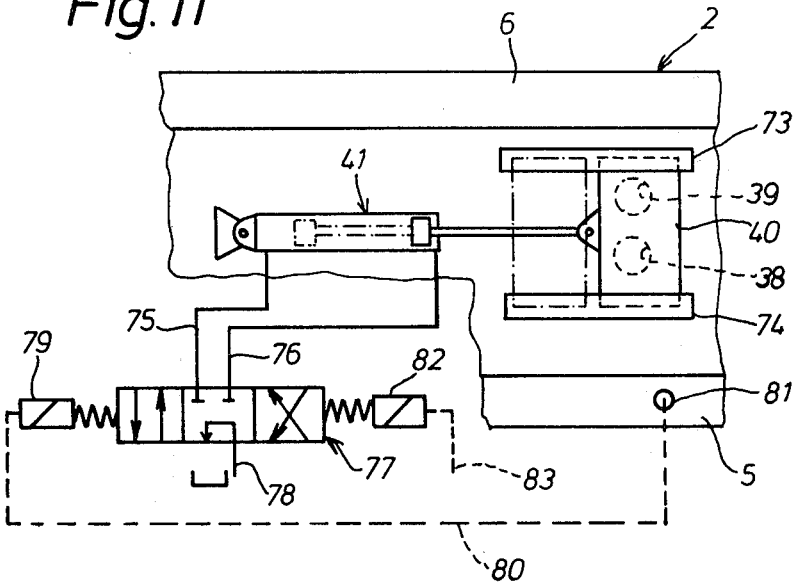
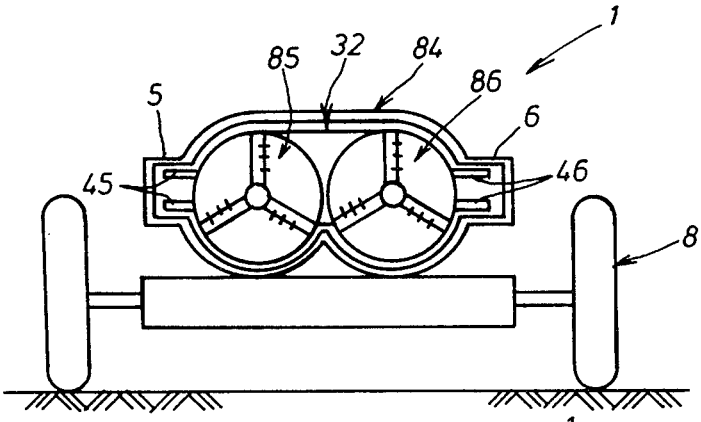
Fig. 12
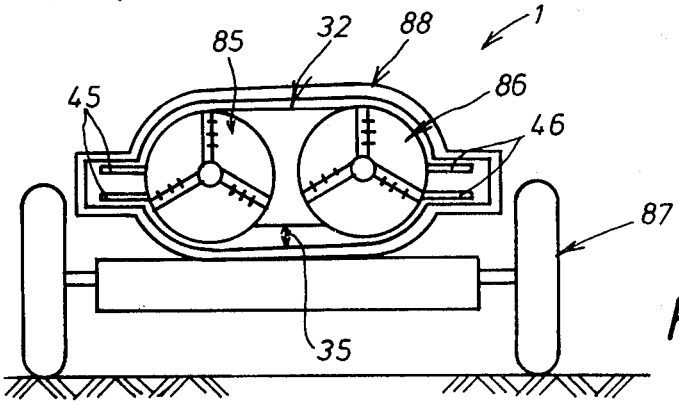
Fig. 13

MOUNTED DRILLING APPARATUS

BACKGROUND OF THE INVENTION

The invention relates generally to rock, mineral or ore drilling apparatus, and in particular to a drilling apparatus having an elongated mount on which is supported a feeding device for a power driven rotary member which holds a drill pipe or rod and moves the same along the mount, and further including guiding elements provided on the mount to guide the feeding device and intercept the rotary moment of the drive.

In a known drilling apparatus of this type constructed as a wagon drill (German published patent application No. 1 244 690) the mount and the drill pipes with the rotary drive are arranged on top of a mobile carriage whereby the drill pipes lie above the mount. The disadvantage of this structure is a relatively large vertical dimension of the apparatus and a relatively large minimum clearance of the drill pipes from the ground level.

SUMMARY OF THE INVENTION

It is therefore a general object of the present invention to overcome the aforementioned disadvantages.

More particularly, it is an object of the invention to provide an improved drilling apparatus which has a reduced vertical dimension.

An additional object of the invention is to simplify the mount for the feeding and the driving means.

In keeping with these objects, and others which will become apparent hereafter, one feature of the invention resides in the provision of a longitudinal passageway or recess in the mount, and accommodating at least partially the feeding mechanism and the rotary drive for the drill rods in the passage and forming the mount with guiding means arranged along the passage and cooperating with the rotary drive to guide the same along the passage and to intercept the rotary moment of the drive.

This arrangement results in a compact structure requiring a relatively small working space. The parts of the drilling apparatus which are arranged inside the passageway or recess of the mount are effectively protected against the outer influences.

The field of application of the mounted drilling apparatus of this invention is particularly the so-called collapse drilling for forming large bore holes. In the collapse drilling a bore hole of a relatively large diameter is drilled and thereupon a plurality of blast holes of smaller diameter are drilled according to a certain pattern around the large bore hole for being exploded in a known manner.

In one embodiment of this invention the mount has the form of a cylindrical shell defining an open U-shaped recess. Particularly advantageous is the modification in which the shell with its open side upwards is employed for conveying by means of a spiral drill rod the drilled material from the bore hole.

According to another feature of this invention, an annular transverse piece can be provided at least around the front edge of the recessed passageway in the mount in order to guide the drill rod on the mount and simultaneously to reinforce the latter. In another modification of this invention the cylindrical mount can be reinforced by a plurality of ring-shaped transverse pieces distributed uniformly over the entire length of the mount.

In still another embodiment of the invention the mount has a form of a cylindrical tube the interior of which delimits the passageway for the guiding means and the rotary drive. This embodiment distinguishes by a very simple structure and by a considerable rigidity while the minimum overall dimensions are maintained. In a mobile drilling apparatus of this kind the minimum clearance of the drill pipe from the ground level can be kept very low.

In still another embodiment of this invention the clearance of the shell or the clearance of the cylindrical tube forming the mount is adjusted to the diameter of a spiral drill rod. The spiral drill pipe rotates in the passageway of the mount only with a very small play so as to achieve the most effective transportation of the drilled material through the passageway.

According to another feature of this invention the bottom wall of the shell or of the tubular mount is provided with a plurality of openings spaced apart one from the other in the direction of the longitudinal axis of the mount whereby at least one of the openings is selectively closed or opened by a closing element. The purpose of these openings is to discharge the drilled material conveyed by the spiral drill pipe from the drill hole rearwardly and accumulate the drilled material in desired amounts below the longitudinal mount. In this manner it is achieved that particularly in the case of large diameter bore holes the drilled material is prevented from piling in the area of the outlet of the bore hole and thus the drilling process is performed without any impedance or blocking. The closing elements can be constructed as power actuated sliders arranged on the outer surface of the mount.

In still another embodiment of this invention each closing element cooperates with a switching member of a control circuit arranged on the mount. Each switching member can be, for example, in the form of a contactless switch controlled by guiding members of the rotary drive so that all of these switching elements can be successively actuated during the advancement of the rotary drive. Accordingly, in response to the advance of the drill pipe in the bore hole the closing elements are automatically opened in a consecutive order from behind forwardly. It is of course also possible to control the openings in the reverse order to open consecutively from the front end of the mount toward the rear end or in another arbitrary succession in order to accumulate below the mount a uniformly distributed drilled material so that the drilling process can continue without any obstructions.

To insure a trouble-free and complete discharge of the drilled material from the aforementioned openings in the mount, according to still another feature of this invention the openings are slightly offset from the lowermost bottom points of the trough-shaped or tubular mount in the direction of rotation of the spiral drill pipe. This offset arrangement is advantageous due to the fact that the rotating spiral pipe lifts the drilled material to one side of the inner wall of the mount and the corresponding positional adjustment of the openings improves the discharge.

A further novel feature in a self-propelled drilling apparatus of this invention is the provision of adjustable supporting legs or jacks which at least in the front region of the mount are arranged on transverse arms extendable in the direction transverse to the longitudinal axis of the mount whereby the legs are extendable in a perpendicular direction. The supporting legs can be in the form of hydraulically controlled cylinder and piston units by means of which the mount is levelled in a known manner. The lateral extension of the holding arms of the legs serves for providing sufficient width of the base of the drilling apparatus, particularly in the case when drill holes of an extra large diameter are bored and correspondingly increased reaction moments are generated.

The stability of the mobile drilling apparatus is further improved when according to still another feature of this invention at least the front supporting legs are provided with a drilling element for drilling an anchoring bore hole in the ground in which the supporting leg is anchored. Due to the insertion of the front supporting legs into the anchoring bore holes it is ensured that the entire drilling apparatus is effectively anchored to withstand not only the thrust in the feeding direction, but also is capable of withstanding reaction forces resulting during the back movement of the drill pipes in the longitudinal direction of the mount.

If excessive reaction rotary moments are expected, the stability of the mobile drilling apparatus can be further improved when the supporting legs are equipped in addition to the drilling elements also with an anchoring device for setting anchoring means into the ground.

In a modification of this invention, the elongated mount of the mobile drilling apparatus is provided with an additional pusher leg or strut in the form of a cylinder and piston unit arranged on the side of the mount which due to the reaction rotary moments transmitted from the bore hole on the guiding members of the rotary drive is prone to tilt and this counteracting cylinder and piston unit presses on the roof of the mine. This counteracting cylinder and piston unit is telescopically extendable so as to reach over extending lengths in the bore hole.

An auxiliary additional supporting cylinder and piston unit can be provided on the mount to lift or lower the counteracting cylinder and piston unit in accordance with particular operational needs. For example, the counteracting cylinder and piston unit can be tilted to the rear and upwardly when considered in the direction of drilling so as to provide an additional stabilizing elbow lever effect. Moreover, these cylinder and piston units can be continuously controlled in a conventional manner by a hydraulic accumulator so as to continuously ensure a reliable bias of the cylinder and piston units against the roof of the mine.

According to still another feature of this invention the rotary drive is spaced apart from the bottom of the passageway in the mount at a distance corresponding to the spacing preserved for the passage of the conveyed drilled material. This arrangement enables an undisturbed drilling operation even in the case when in the lower range of the longitudinal passageway a layer of the drilled material is deposited.

In the preferred embodiment of this invention, the guiding means for the rotary drive are in the form of guiding rails attached to the shell or integrated in the wall of the tubular mount whereby the rotary drive is provided with radially projecting guiding members slidably guided in these rails. This arrangement is particularly rigid and spacesaving and, in addition, it contributes to the protection of all component parts of the drilling apparatus inside the tubular mount.

Preferably, to intercept during the drilling operation all impacts and rotary moments, there are with advantage provided two diametrically opposed guiding rails and guiding members.

The feeding device in the drilling apparatus of this invention has feeding elements arranged in one of the guiding rails in the passageway of the mount so as to ensure a good protection against external influences. According to this invention, it is also possible to arrange in each guiding rail a tooth rack which is in mesh with a corresponding pinion on the rotary drive.

According to still another embodiment of this invention the feeding device includes deviation rollers for a feed cable or chain arranged in the recesses of the U-shaped guiding rails, the chain or cable being at one end attached to the rotary drive and at the other end to a feed cylinder and piston unit. Even in this case a good protection of the feeding mechanism against outer disturbances is ensured.

In a modification, the deviation rollers are arranged in the recesses of the guiding rails at both ends of the mount whereby the feed cable or chain which is attached at one end to the rotary drive is guided in the guiding rails past the deviation rollers to a power drive for the feeding mechanism which in this case is arranged on the outer surface of the elongated mount. This arrangement is suitable particularly in the case where an increased power for the feeding mechanism is requested whereby a sufficiently low profile of the drilling apparatus is still maintained.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 11 is a schematic diagram of a hydraulic control circuit for a closure element for discharge openings in the bottom of the mount;

FIG. 12 is a front view of another embodiment of the apparatus of this invention; and FIG. 13 is a modified version of the apparatus of FIG. 12.

DESCRIPTION OF THE PREFERRED EMBODIMENTS

Figures 1, 3, 4, 5:
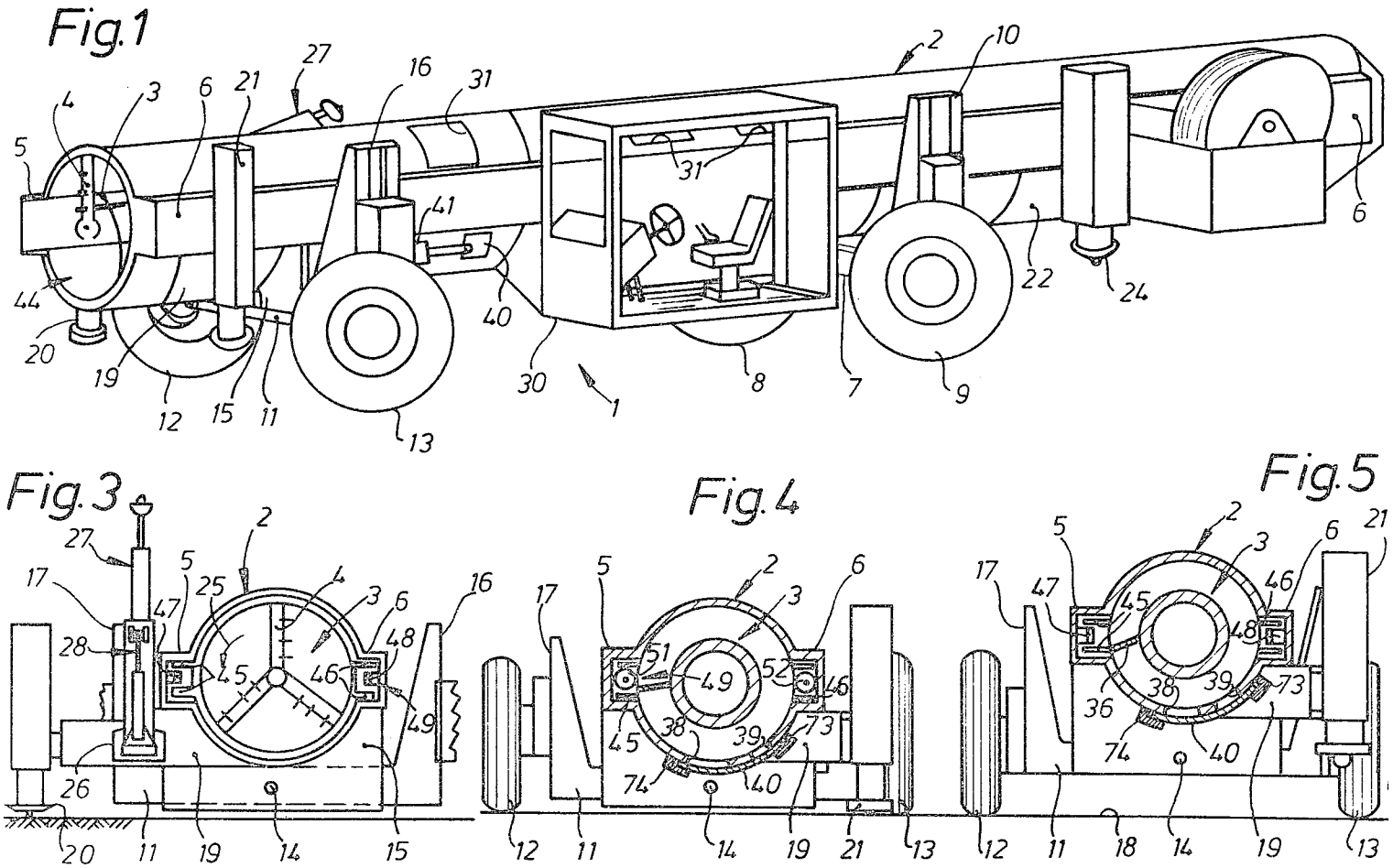
FIG. 1 is a perspective view of a self-propelled drilling apparatus having a tubular mount for the drilling elements.
FIG. 3 is a front view of the apparatus of FIG. 2 taken along the line III—III.
FIG. 4 is a sectional front view of the apparatus of FIG. 2 taken along the line IV—IV.
FIG. 5 is a view similar to FIG. 4 but shown in a different operational position of the mount.

FIG. 1 shows a self-propelled drilling apparatus 1 having a mount 2 in the form of a cylindrical tube for enclosing drilling and feeding subunits of the apparatus. The cross section of the passageway in the mount 2 is substantially circular and is dimensioned to fit with a small play a spiral drill pipe 3 provided with a drilling bit 4. The tubular mount 2 is provided with diametrically opposed and outwardly projecting guiding rails 5 and 6 extending over the entire length of the mount for guiding a rotary drive or chuck for the drill pipe, as it will be explained in more detail below.

The rear part of the mount 2 rests on a rigid transverse shaft 7 supporting for rotation steerable rear wheels 8 and 9. The individual rear wheels are vertically adjustable by a non-illustrated control mechanism of a conventional design in vertical guides 10 secured to the mounts 2. The front part of the mount rests on a jointed cross shaft axle 11 with vertically adjustable non-steerable front wheels 12 and 13. As seen in more detail in FIGS. 3 to 5, the cross shaft 11 is swingably supported at its center on a pivot pin 14 which is supported in axial direction of the mount 2 on a reinforcing transverse frame 15. The ends of the cross shaft 11 are also provided with vertical guides 16 and 17 in which the individual front wheels 12 and 13 are vertically adjustable by non-illustrated control means such as for example cylinder and piston units.

The vertical adjustability of the rear wheels 8 and 9 and of the front wheels 12 and 13 enables that the elongated mount 2 can be angularly adjusted relative to the ground level both in the axial direction and in the transverse direction (FIGS. 1 and 5). In other words, the universal angular adjustability ensures that the drilling apparatus of this invention can be adjusted to a desired working position irrespective of relatively large irregularities of the ground 18. At the same time, as seen from FIGS. 3 and 4 the mount 2 can be also lowered to a considerable degree. For this purpose, the hydraulically controlled supporting legs 20 and 21 are provided on a front transverse reinforcing member 19 and hydraulically controlled supporting legs 23 and 24 are attached to the rear transverse reinforcing member 22. The front supporting legs 20 and 21 are laterally extendable from the transverse member 19 in order to increase the supporting base of the drilling apparatus.

Figure 2:
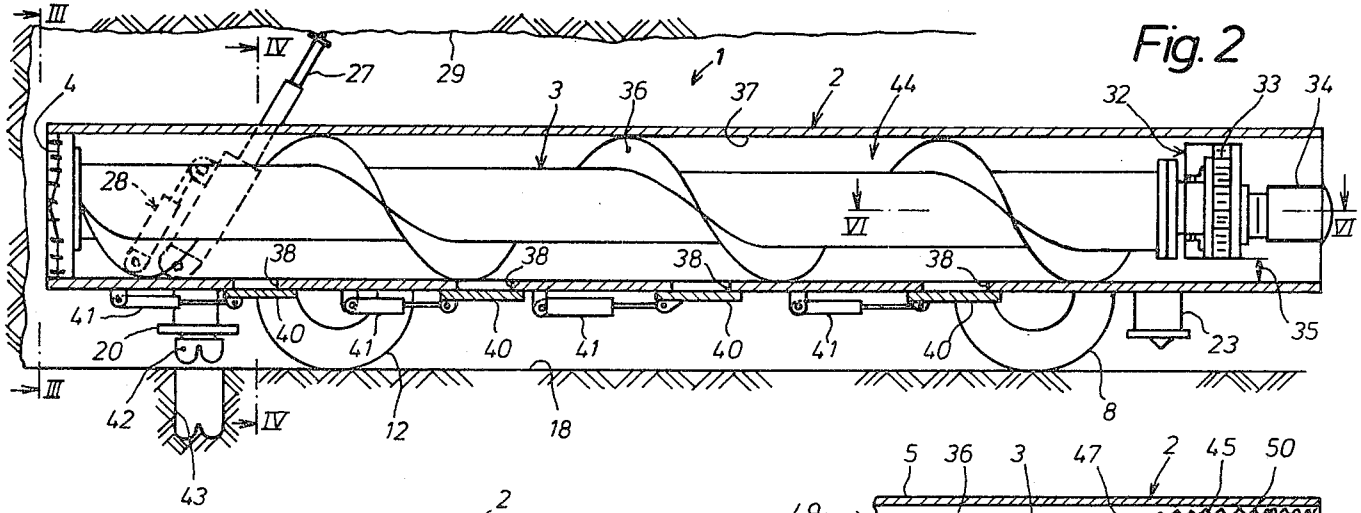
FIG. 2 is a side view, partly in section of the apparatus of FIG. 1.

The direction of rotation of the drill pipe 3 is indicated by arrow 25 in FIG. 3. In order to counteract the rotary moment exerted on the mount 2, one side of the transverse member 19 supports a telescopic arrangement of cylinder and piston units 27 and 28 which are pivotally mounted on a bearing block 26 on the transverse reinforcing member 19. The telescopically extendable cylinder and piston unit 27 is designed for abutting against the roof of a horizontally directed bore hole whereas the angular adjustment of the main unit 27 is effected by an auxiliary cylinder and piston unit 28 which is hinged between a projecting lug on the unit 27 and the bearing block 26. FIG. 2 illustrates a working position of the cylinder and piston unit 27 when engaging the roof 29 at a sharp angle with respect to the axis of the drill pipe so as to ensure by means of an elbow lever effect, a reliable anchoring of the drilling apparatus in its working position.

Referring again to FIG. 1, a driver's cabin 30 is attached to the left side of the mount 2 between the rear wheel 9 and the front wheel 13. Window-like openings 31 are formed in the walls of the tubular mount 2 above the guiding rails 5 and 6 and in front of the window in the driver's cabin 30 so that the operator might observe the interior of and the area beyond the mount during the drilling operation.

As seen from FIG. 2, a turntable or rotary drive 32 is clamped to the rear end of the spiral drill pipe 3. The rotary drive 32 includes transmission gears 33 driven by a motor 34. The lowermost point of the rotary drive 32 is spaced from the bottom part of the passageway in the mount 2 about a distance 35 which permits the passage of the drilled material conveyed rearwardly by the helix 36 of the drill pipe. Due to the fact that the helix 36 rotates in the tubular passage of the mount 2 only with a minimum play, even the smallest particles of the drilled material are forwarded from the left to the right. In order to discharge the transported material, the bottom part of the tubular mount 2 is provided with two axially directed rows of discharge openings 38 and 39. Openings 38 are arranged along the lowermost axial zone of the mount 2 whereas openings 39 are offset in the direction of arrow 25, that means in the rotary direction in which a certain amount of the drilled material is lifted by the spiral 36 on the inner wall of the passageway. Each of the discharge openings 38 and 39 is closable by a sliding closure element 40 whereby the closure elements are selectively operable by a cylinder and piston unit 41 into its closing or opening position. At the beginning of the drilling operation, all discharge openings are closed except those at the rear end of the mount so that the first amount of transported drilled material is discharged under the rear part of the mount. During the penetration of the drill pipe into the bore hole, the closure elements 40 are consecutively opened from the right to the left until the closure element 40 at the left end of the mount 2 is opened and the discharged drilled material is uniformly distributed under the mount.

The outer diameter of the spiral drill pipe 3 can be, for example, 1 meter. In the case of such large diameters, reaction forces and moments transmitted to the drilling apparatus 1 can be so large that the anchoring cylinder and piston unit 27 can no longer stabilize the working position of the apparatus. For this reason, the front supporting legs 20 and 21 are equipped with coaxially directed anchoring drilling devices 42 which, as seen from FIG. 2, drill an anchoring bore hole 43 in desired points of the floor or ground 18 of the bore hole, whereby the extended drilling portion of the legs remain anchored therein during the entire horizontal drilling operation. The anchoring drilling device 42 is coaxially arranged in respective supporting legs 20 and 21 and in FIG. 2 is illustrated in its retracted position. When extended into the anchoring bore hole 43, the drill rod 42 ensures positive blocking of the mount 2 against any displacement. If necessary, an additional anchor can be inserted in perpendicular direction into the anchoring bore hole 43 so that the positive hold of the drilling apparatus 1 is still increased.

The elongated cylindrical passage 44 in the tubular mount 2 as mentioned before, communicates with two diametrically opposed elongated guiding recesses delimited by the interior of U-shaped guiding rails 5 and 6 integrally connected to the jacket of the mount 2. These elongated guiding recesses engage guiding elements 45 and 46 (FIG. 3) projecting from the rotary drive 32; in this manner, the rotary drive 32 can be advanced in axial direction whereby its rotary moment is intercepted by the guiding rails 5 and 6 on the mount 2. At least one of the guide rails 5 and 6 is provided on its inner wall with a tooth rack 47 or 48 of feeding device 49 for the rotary drive 32. Each of the tooth racks 47 and 48 is in mesh with a pinion 50 (FIG. 6) mounted on the casing of the rotary drive and being coupled to a feeding drive 51*a* of the feeding mechanism 49.

Figure 6:
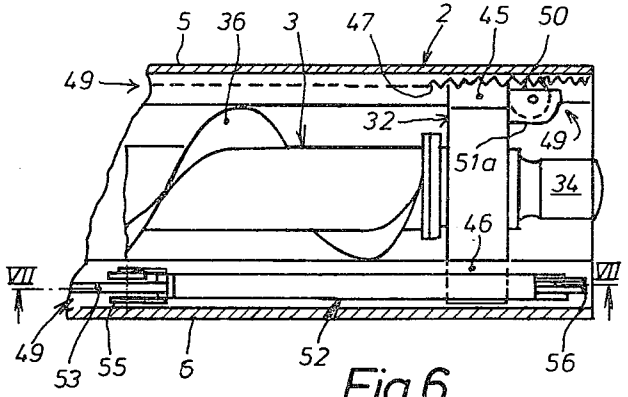
FIG. 6 is a top view, partly in section, of a cutaway portion of the device of FIG. 2, taken along the line VI—VI.
Figure 7:
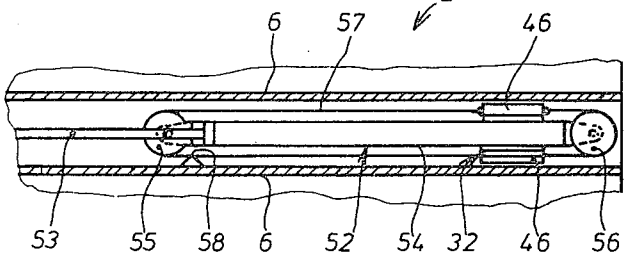
FIG. 7 is a sectional view of a part in FIG. 6, taken along the line VII—VII.

Instead of tooth racks 47 and 48 as depicted in FIGS. 3 and 5, the feeding mechanism 49 can include also pneumatic or hydraulic cylinder and piston units 51 and 52 arranged in the recessed guiding rails 5 and 6. It is also possible to combine the rack and pinion drive 47 and 50 with a cylinder and piston unit 52 in the opposite guiding rail as depicted in FIG. 6. Nevertheless, in most cases the feeding mechanism includes either a pack of rack and pinion drives or a pair of cylinder and piston units. FIG. 7 illustrates in greater detail a cylinder and piston unit 52 and its coupling to the rotary drive 32 for the drill pipes. A piston rod 53 of the unit 52 is hinged at its free end to the mount 2. The cylinder 54 of the unit 52 supports for rotation two deviation rollers 55 and 56 for a feeding chain 57 which at one end thereof is connected to the outer casing of the rotary drive 32 and at its other end is secured to the mount 2. In this manner the feeding stroke during the movement of the cylinder 54 relative to the piston rod 53 is doubled.

Figure 8:
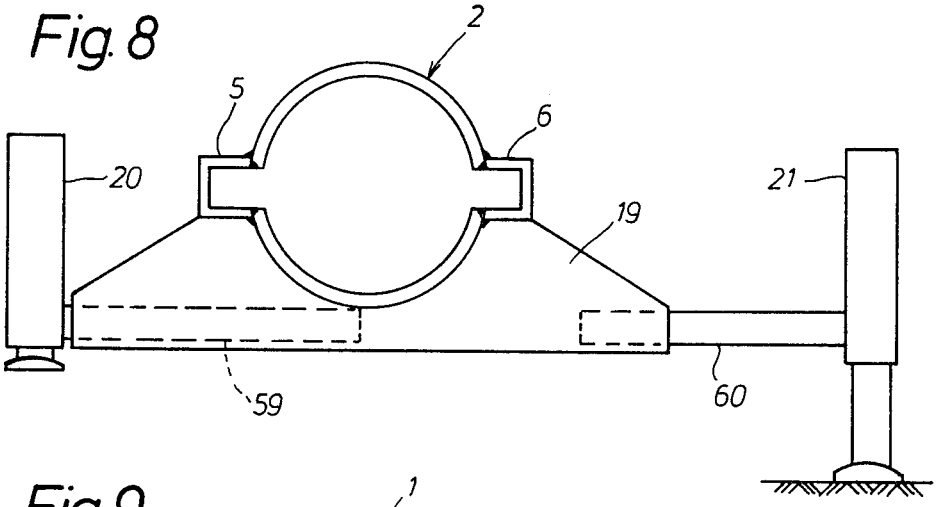
FIG. 8 is a front view of the mount of the drilling apparatus of this invention having laterally extendable supporting legs.

According to FIG. 8, the front reinforcing transverse member 19 is formed with downwardly sloping shoulders extending below the mount 2 and these shoulders are provided with guiding passages for laterally movable supporting arms 59 and 60 which, at their free ends, are connected to the vertically adjustable supporting legs 20 and 21. In this manner, the size of the supporting base for the drilling apparatus can be adjusted according to particular working conditions.

Figure 9:
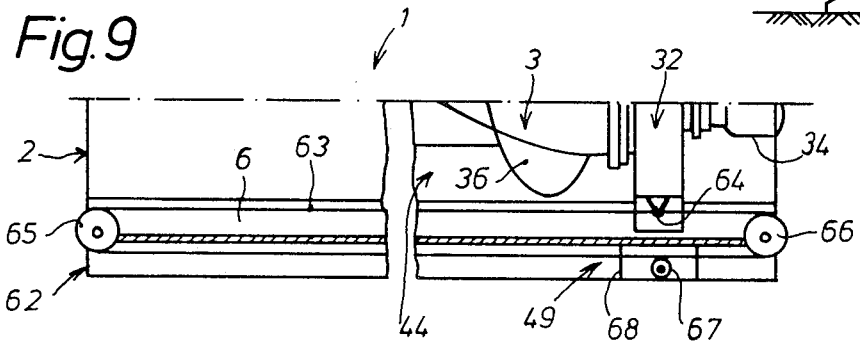
FIG. 9 is a cutaway portion of an embodiment of the feeding mechanism for the rotary drive in the apparatus of this invention.
Figure 10:
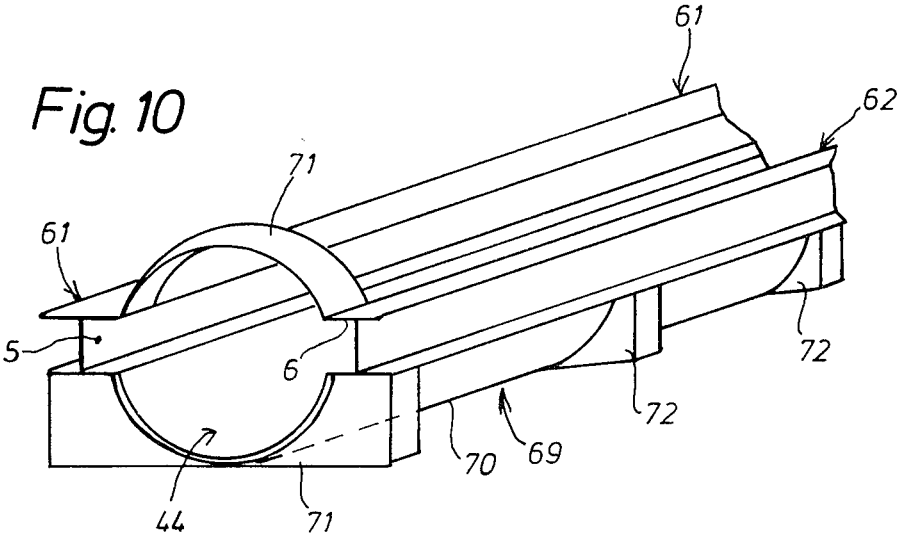
FIG. 10 is a perspective view of a front end portion of another embodiment of the mount of this invention.

FIG. 9 illustrates another modification of the feeding device 49 in which deviation rollers 65 and 66 are supported for rotation in the longitudinal recesses of the guiding rails 61 and 62 which in this case have an I-profile (FIG. 10). A feed chain 63 is guided around the deviation rollers and is secured at a connection point 64 to the outer casing of the rotary drive 32. The feed chain 63 is driven by a driving pinion 67 of a power drive 68 of the feeding mechanism. The feeding power drive 68 as well as the outer run of the chain 63 are located in the outer channel of the I profiled rails 61 and 62.

A modified version of the elongated mount 69 is shown in FIG. 10. The mount 69 is constituted of a cylindrical half shell 70 having its open side directed upwardly and the elongated edges of the half shell are connected by welding to I-profiled rails 61 and 62. A semi-circular transverse reinforcing piece 71 is connected at the front end of the mount 69 to the upper edges of the guiding rails 61 and 62. The reinforcing piece 71 also serves for guiding the drill pipe. The lower surface of the half shell 70 is also reinforced by transverse pieces 72. The modified mount 69 is equipped with similar accessory members such as a mobile undercarriage and supporting legs as the mount 2 in the aforedescribed example.

FIG. 11 shows in full lines a sliding closure element 40 in its closing position above the openings 38 and 39; dash and dot lines indicate the position of the closure element 40 in which the openings are uncovered. The closure element is slidably supported in two guiding straps 73 and 74 attached to the mount 2 (see also FIGS. 4 and 5). A cylinder and piston unit 41 controlling the displacement of the closure element 40 is connected via conduit 75 and 76 to a four-way three position control valve 77 through which a hydraulic fluid from a pressure conduit 78 is supplied into or discharged from the unit 41. A solenoid 79 is connected via a connector 80 to a switching element 81 mounted on the guiding rail 5. The switching element 81 can be a contactless switch activated by the passing guiding member 45 of the rotary drive 32. The solenoid 79 upon energization displaces the valve 77 and the closure element 40 opens the openings 38 and 39. Return springs hold the control valve 77 automatically in its neutral position as illustrated in FIG. 11. In this neutral position the closure element 40 is locked either in its open position or in its closed position. A second solenoid 82 coupled to the opposite end of the valve 77 is energized via conductor 83 and moves the valve 77 into a position in which the unit 41 returns the closure element 40 into its closing position. The actuation of the second solenoid 82 is made by a non-illustrated manually operable switch either for all closing elements 40 simultaneously or selectively.

FIG. 12 shows a self-propelled drilling apparatus 1 with a chassis 87 and a mount 84 formed of a cylindrical tube for accommodating and guiding two spiral drill pipes 85 and 86. A bottom portion of the mount 84 has radii which match with a minimum play the outer contour of the drill pipes 85 and 86 thus ensuring a complete transportation of the drilled material. Both spiral drill pipes 85 and 86 are driven by a common rotary drive 32.

The embodiment of the self-propelled drilling apparatus 1 according to FIG. 13 has a modified mount 88 which differs from the mount of FIG. 12 only in the flat configuration of its bottom wall and in a slightly increased spacing between the drilling pipes 85 and 86.

It will be understood that each of the elements described above, or two or more together, may also find a useful application in other types of constructions differing from the types described above.

While the invention has been illustrated and described as embodied in a mobile drilling apparatus for use with helical drill pipes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A drilling apparatus comprising a mount formed with a longitudinal passageway; a feeding mechanism at least partially arranged in said passageway; a rotary drive including means for holding at least one drill rod, said rotary drive being at least partially arranged in said passageway and coupled to said feeding mechanism for being longitudinally moved in said passageway; means provided on said mount for guiding said rotary drive in a fixed angular position during its longitudinal movement in said passageway and for intercepting the reaction moments generated in the course of the drilling operation, and wherein said mount is constituted by a cylindrical shell delimiting a passageway having an outward opening which extends in longitudinal direction over a major part of the shell.

2. A drilling apparatus as defined in claim 1, wherein at least the front end of the shell is reinforced by at least one transverse piece forming part of a circular ring and bridging said outward opening.

3. A drilling apparatus as defined in claim 1, wherein the bottom of the shell is reinforced by a series of transverse pieces.

4. A drilling apparatus comprising a mount formed with a longitudinal passageway; a feeding mechanism at least partially arranged in said passageway; a rotary drive including means for holding at least one drill rod, said rotary drive being at least partially arranged in said passageway and coupled to said feeding mechanism for being longitudinally moved in said passageway; means provided on said mount for guiding said rotary drive in a fixed angular position during its longitudinal movement in said passageway and for intercepting the reaction moments generated in the course of the drilling operation, and wherein said at least one drill rod includes a helical portion, the outer contour of which matches at least the bottom part of said passageway to convey the drilled material.

5. A drilling apparatus as defined in claim 4, wherein said mount at the bottom part of said passageway is provided with a plurality of openings distributed in the longitudinal direction of said passageway and with closure elements assigned to at least one of said openings and being operable into a closed and an open position.

6. A drilling apparatus as defined in claim 5, further including control means for respective closure elements arranged on the outer surface of said mount.

7. A drilling apparatus as defined in claim 6, wherein said control means includes a switch activated in response to the passage of said rotary drive in said guiding means.

8. A drilling apparatus as defined in claim 5, wherein said openings are arranged in two parallel rows extending side-by-side in the longitudinal direction of said passageway, one of said rows being located at the lowermost zone of the bottom of said passageway and the other row being laterally offset in the direction of rotation of said drill rod.

9. A drilling apparatus comprising a mount formed with a longitudinal passageway; a feeding mechanism at least partially arranged in said passageway; a rotary drive including means for holding at least one drill rod, said rotary drive being at least partially arranged in said passageway and coupled to said feeding mechanism for being longitudinally moved in said passageway; means provided on said mount for guiding said rotary drive in a fixed angular position during its longitudinal movement in said passageway and for intercepting the reaction moments generated in the course of the drilling operation; said mount being supported on a self-propelled undercarriage, said undercarriage including a front pair and a rear pair of vertically adjustable supporting legs, and means for adjusting the transverse position of at least the front pair of the supporting legs; and wherein at least the front pair of supporting legs is provided with a coaxially arranged drilling device for drilling an anchoring bore hole in which it is anchored to intercept reaction forces and moments during the drilling operation.

10. A drilling apparatus as defined in claim 9, wherein said drilling device on at least said front supporting legs includes an anchoring device for inserting anchors into said anchoring bore holes.

11. A drilling apparatus comprising a mount formed with a longitudinal passageway; a feeding mechanism at least partially arranged in said passageway; a rotary drive including means for holding at least one drill rod, said rotary drive being at least partially arranged in said passageway and coupled to said feeding mechanism for being longitudinally moved in said passageway; means provided on said mount for guiding said rotary drive in a fixed angular position during its longitudinal movement in said passageway and for intercepting the reaction moments generated in the course of the drilling operation; a lateral side of the mount pivotably supporting an extendable cylinder and piston unit operable for engaging the roof of the mine to intercept rotary reaction moments during the drilling operation; and further including an auxiliary cylinder and piston unit hinged between said mount and said cylinder and piston unit to adjust the angular position of the latter.

12. A drilling apparatus comprising a mount formed with a longitudinal passageway; a feeding mechanism at least partially arranged in said passageway; a rotary drive including means for holding at least one drill rod, said rotary drive being at least partially arranged in said passageway and coupled to said feeding mechanism for being longitudinally moved in said passageway; means provided on said mount for guiding said rotary drive in a fixed angular position during its longitudinal movement in said passageway and for intercepting the reaction moments generated in the course of the drilling operation, and wherein said rotary drive includes a non-rotating casing which is spaced from the bottom of said passageway about a distance sufficient for permitting an undisturbed flow of the drilled material.

13. A drilling apparatus comprising a mount formed with a longitudinal passageway; a feeding mechanism at least partially arranged in said passageway; a rotary drive including means for holding at least one drill rod, said rotary drive being at least partially arranged in said passageway and coupled to said feeding mechanism for being longitudinally moved in said passageway; means provided on said mount for guiding said rotary drive in a fixed angular position during its longitudinal movement in said passageway and for intercepting the reaction moments generated in the course of the drilling operation; said guiding means including guiding rails integrally connected to the wall of said mount and each defining an elongated recess extending along and communicating with said passageway; said rotary drive having a non-rotating casing provided at opposite sides with outwardly projecting guiding members engaging into said longitudinal recesses in said guiding rails; and wherein said guiding rails are arranged on diametrically opposite lateral wall portions of said mount.

14. A drilling apparatus comprising a mount formed with a longitudinal passageway; a feeding mechanism at least partially arranged in said passageway; a rotary drive including means for holding at least one drill rod, said rotary drive being at least partially arranged in said passageway and coupled to said feeding mechanism for being longitudinally moved in said passageway; means provided on said mount for guiding said rotary drive in a fixed angular position during its longitudinal movement in said passageway and for intercepting the reaction moments generated in the course of the drilling operation; said guiding means including guiding rails integrally connected to the wall of said mount and each defining an elongated recess extending along and communicating with said passageway; said rotary drive having a non-rotating casing provided at opposite sides with outwardly projecting guiding members engaging into said longitudinal recesses in said guiding rails; said guiding rails being arranged on diametrically opposite lateral wall portions of said mount, and wherein said feeding mechanism includes feed drives arranged in the longitudinal recesses of said guiding rails.

15. A drilling apparatus as defined in claim 14, wherein said feed drive includes tooth racks provided in said longitudinal recesses of said guiding rails and power driven pinions mounted on the casing of said rotary drive and engaging said toothed racks.

16. A drilling apparatus as defined in claim 14, wherein said feed drive includes a cylinder and piston unit arranged in respective recesses of said guiding rails, the free end of said piston being attached to said mount, the cylinder of said unit supporting at each end a deviation roller, and a feed cable or chain guided on the deviation rollers and being attached at one end to the mount and at the other end to the case of said rotary drive.

17. A drilling apparatus as defined in claim 14, wherein said feed drives include two deviation rollers arranged for rotation in said elongated recesses of said guiding rails at each end of the mount, a looped feed cable or chain supported on the deviation rollers and being attached to the casing of the rotary drive whereby one run of the cable or of the chain is guided along the outer surface of the assigned guiding rail and drive means arranged on the outer surface of a guide rail for driving said cable or chain.

* * * * *